United States Patent [19]

Kulson

[11] 4,072,476

[45] Feb. 7, 1978

[54] AUTOMATIC LOADER

[75] Inventor: Walter A. Kulson, Plymouth, Mich.

[73] Assignee: Wit-Son Carbide Tool, Inc., Plymouth, Mich.

[21] Appl. No.: 612,291

[22] Filed: Sept. 11, 1975

[51] Int. Cl.[2] ..... B24B 19/08

[52] U.S. Cl. ..... 51/215 H; 214/8.5 C

[58] Field of Search ..... 51/215 AR, 215 R, 215 H, 51/215 HM, 215 CP; 214/8.5 C

[56] References Cited

U.S. PATENT DOCUMENTS

| | | | |
|---|---|---|---|
| 3,665,656 | 12/1970 | Newsome | 51/215 H |
| 3,680,267 | 8/1972 | Vale | 51/215 H |
| 3,707,809 | 1/1973 | Schnellman | 51/215 H |

*Primary Examiner*—Gary L. Smith

*Attorney, Agent, or Firm*—Krass & Young

[57] ABSTRACT

A loader for conveying workpieces from a magazine stack to a clamping spindle where a grinding operation is performed. The loader comprises a reciprocally displaceable carrier assembly having a part holder assembly disposed on the end thereof for laterally receiving and axially releasing small workpieces such as triangular machine tool inserts. The part holder assembly defines a substantially triangular seat having a lateral support surface and being notched out to provide access for the clamping spindle. Precise adjustment of the insert seat is accomplished by means of a cam screw which extends through the part holder assembly to the carrier plate. A relief valve is provided to relax pressure on the part stack during carrier operation to reduce wear due to the sliding of the carrier assembly past the workpiece stack.

13 Claims, 7 Drawing Figures

Fig-1
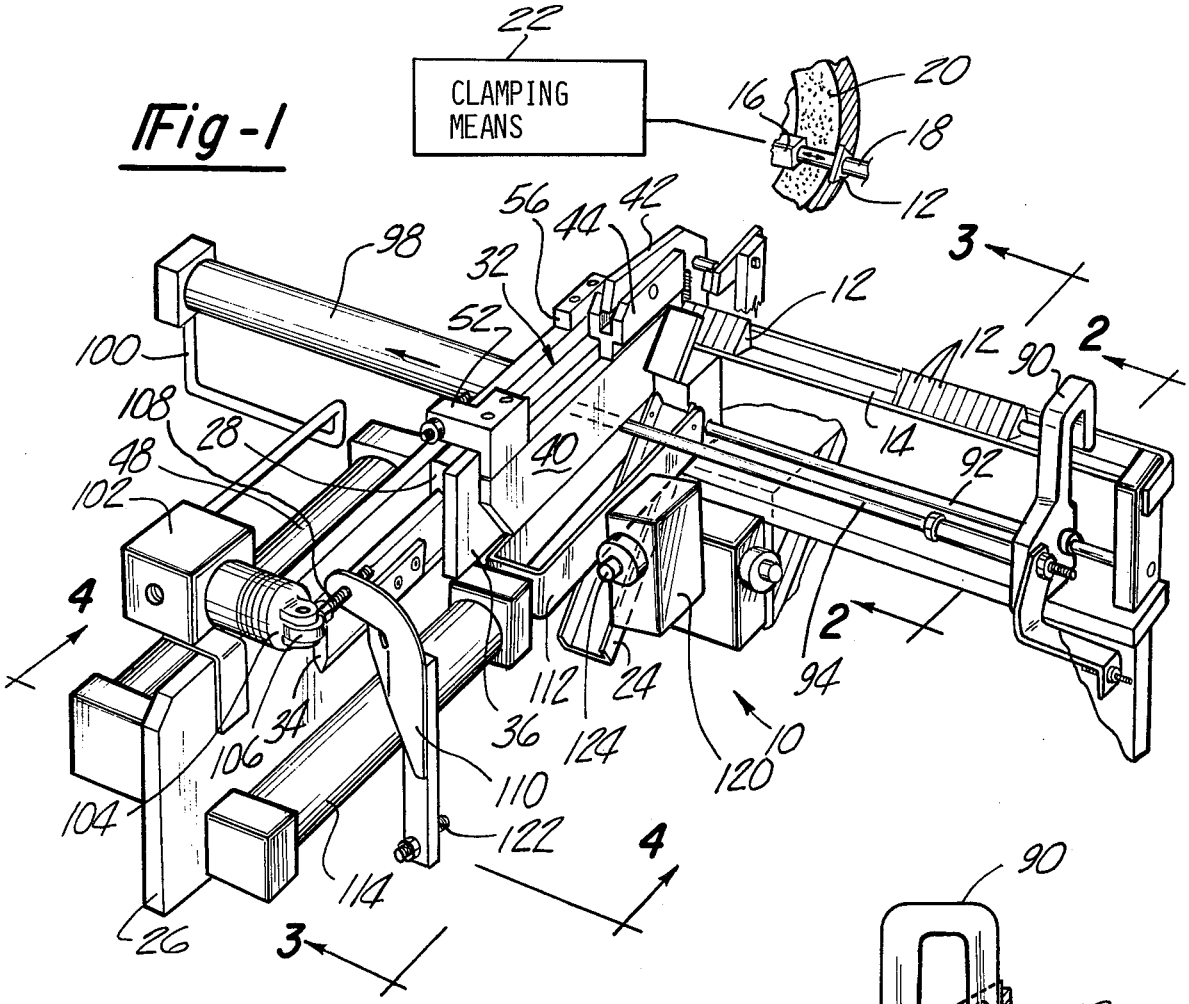
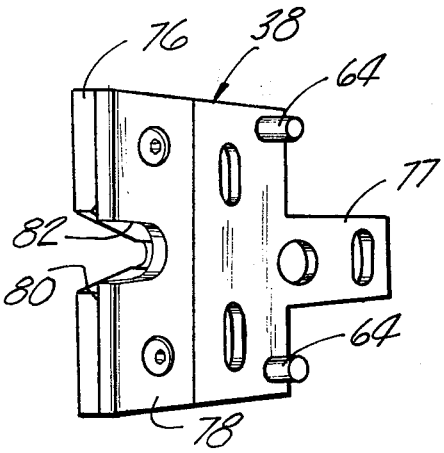
Fig-5
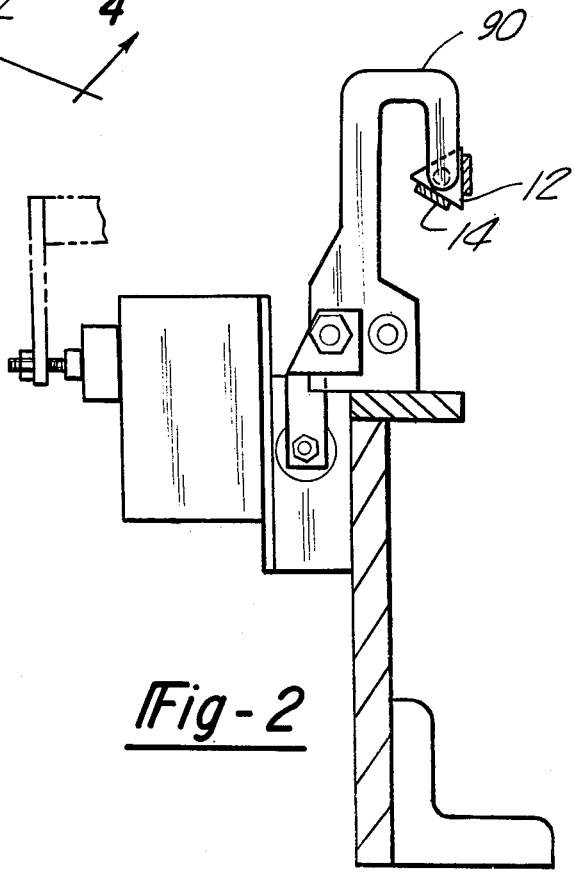
Fig-2

AUTOMATIC LOADER

INTRODUCTION

This invention relates to transfer systems, commonly called loaders, for automatically conveying small workpieces from a magazine stack to a clamping spindle or the like for the subsequent performance of workpiece finishing operations.

BACKGROUND OF THE INVENTION

Transfer systems or loaders, as they are commonly called, are used to automatically convey workpieces from one point to another in many industrial applications. One such application is the conveyance of workpieces from a supply stack or magazine to the clamping spindle of a grinding machine where a finish grinding operation is carried out. Because the workpieces are small and specifically configured, it is necessary that the loader precisely receive the workpiece from the magazine stack and carry it to the finishing station in a known orientation so as to permit the workpiece to be clamped and released for the finishing operation.

A specific application for the present invention as described herein is the automatic loading and grinding of carbide machine tool inserts which, as is well known to those skilled in the art, are small triangular, flat-sided objects which require finish grinding after firing. A commercially available grinder for performing grinding operations on carbide inserts is the universal insert grinder manufactured and sold by Wit-O-Matic, Inc. of Plymouth, Michigan and the loader herein described is readily adaptable for use on the Wit-O-Matic machine.

Prior art loaders are known; one example is the "Workpiece Feed Mechanism" described in the United States Patent to E. M. Newsome, U.S. Pat. No. 3,665,656. In that patent of mechanism for carrying carbide inserts from a magazine stack to a clamping spindle is described. The Newsome mechanism includes, among other things, a retractable workpiece slide (62 in the patent drawing) which supports a face of the insert while in the loader seat and which engages the clamping spindle to retract away from the insert when the loader reaches the clamping station. This mechanism adds to the cost and complexity of the machine and requires periodic maintenance for satisfactory operation. Moreover, the Newsome patent does not disclose a simple and easily operated mechanism for the fine adjustment of the position of the workpiece seat so as to ensure that each workpiece is precisely located therein prior to initiating the transfer from magazine stack to the clamping spindle.

A further problem of prior art devices such as Newsome arises from the fact that it is necessary to apply a bias to the end of the insert magazine stack so as to urge the inserts laterally toward and into the transfer mechanism seat. Accordingly, the face of the next insert to be transferred slides against the side of the transfer mechanism over its entire work stroke to and from the clamping station. The carbide inserts, because of their hardness and abrasive quality, thus produce wear on the side of the transfer mechanism, such wear being related to the bias pressure which is exerted on the workpiece stack to carry out the loading operation.

BRIEF SUMMARY OF THE INVENTION

It is an object of the invention to provide an automatic loader assembly for conveying small workpieces such as machine tool inserts from a magazine stack to a clamping spindle and being of such design as to eliminate the problems of the prior art devices. More specifically, it is an object of the invention to provide a transfer system or loader having a workpiece receiving seat which provides secure support for the workpiece during the transfer operation yet which does not require for lateral workpiece support a spring-biased, retractable slide of the type disclosed in the Newsome patent previously identified. In general, this is accomplished through the provision of an improved workpiece or part holder assembly having a first plate with an aperture configured to receive and support the edges of the workpiece, and a second plate in abutting relationship with the first plate, and having a second aperture aligned with but smaller than the first for receiving and supporting a portion of a face of the workpiece, both apertures however being relieved sufficiently to provide clearance for the clamping spindle arrangement as hereinafter described.

Another object of the invention is to provide an improved workpiece or part holder assembly which provides for the rapid and simple precise adjustment of the workpiece seat thereby to ensure accurate and secure pick-up operations without the need for shimming and adjusting the position of the overall loader assembly. In general, this is accomplished by a combination comprising a slide body mounted for reciprocal displacement between the pick-up position and a release position, a part holder on the slide body and defining a seat for receiving the workpieces laterally thereof and ajustable means interconnecting the part holder means and the slide body for adjusting the position of the part holder means on the slide body. In the preferred embodiment hereinafter described, the adjustment means comprises a simple cam screw and pin-slot interconnection between the part holder means and the slide body to provide positive, precise adjustment of the location of the part holder seat relative to a workpiece stack.

Still another object of the invention is to provide means whereby a bias pressure is applied to a workpiece stack for the purpose of urging the workpieces laterally into the seat of a part holder assembly but wherein pressure is automatically released as the transfer mechanism moves toward the clamping position thereby to reduce or eliminate wear and abrasion of the transfer components while sliding past the next workpiece in the supply stack. In general, this is accomplished by means of a valve and switch arrangement responsive to transfer assembly movement away from the pick-up point to relax the bias pressure on the supply stack other than when needed for lateral workpiece feed.

These and various other features and advantages of the present invention will become more apparent upon a reading of the following specification in which an illustrative and preferred embodiment of the invention is described in detail.

BRIEF DESCRIPTION OF THE DRAWINGS

FIG. 1 is a perspective view of a part loader assembly embodying the invention and adapted specifically for the precision transfer of triangular machine tool inserts from a magazine to a clamping spindle;

FIG. 2 is an end view along section line 2—2 of FIG. 1;

FIG. 5 is a perspective of a part holder detail;

DETAILED DESCRIPTION OF THE SPECIFIC EMBODIMENT

Figures 3, 6:
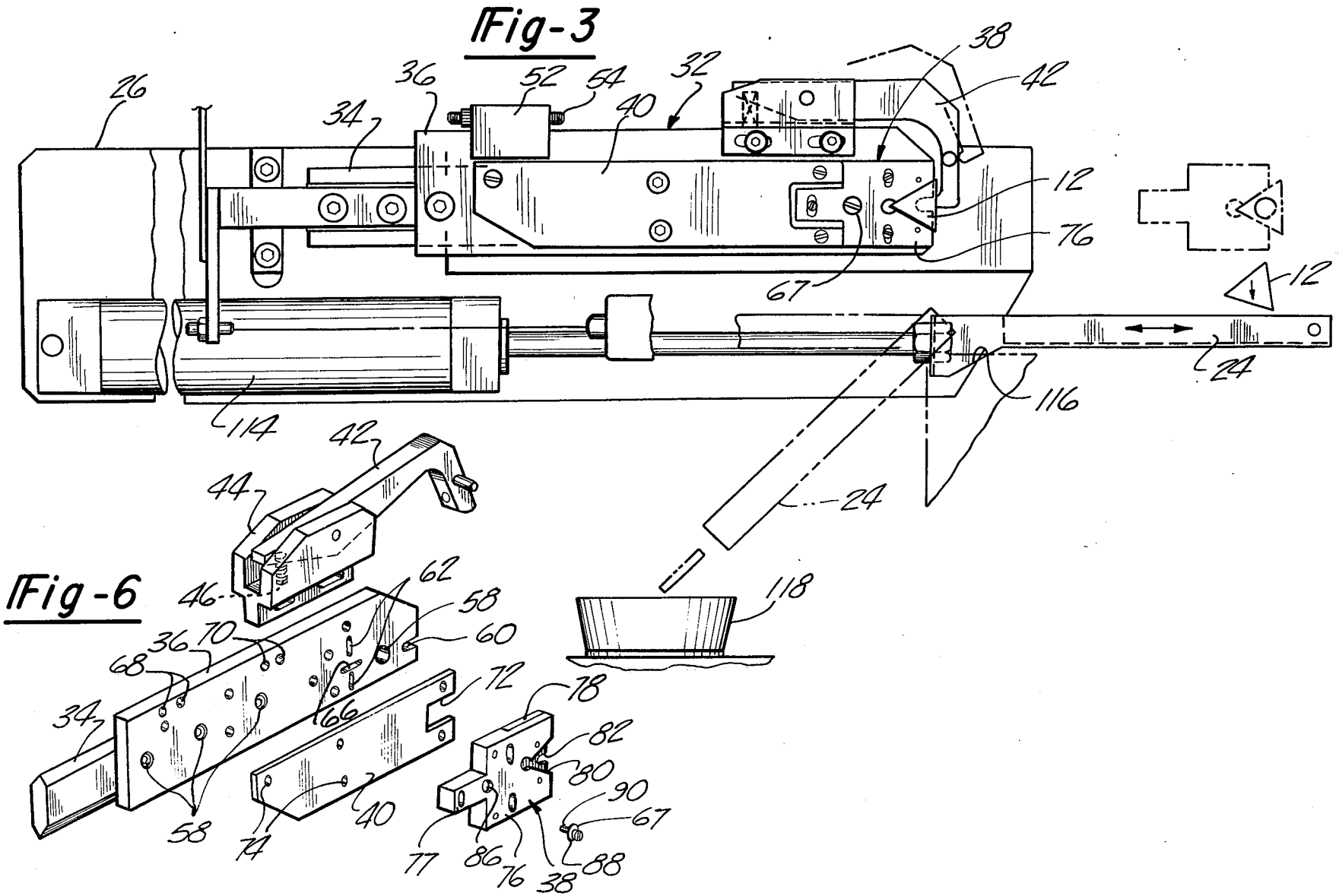
FIG. 3 is a side view of the assembly of FIG. 1.
FIG. 6 is an exploded perspective view of part holder and associated components; and, FIG. 7 is a detailed view of a portion of the part holder showing the preferred form of the location adjustment feature.

Referring to the drawings there is shown a loader apparatus 10 comprising carrier assembly 32 for transferring workpieces, in this instance, triangular carbide machine tool inserts 12, from a magazine 14 to a clamping spindle 16, 18 where the inserts are finish-ground by a diamond wheel 20. The clamping spindle comprises portion 16 which has an internal bearing for free rotation and an axially aligned portion 18 which is controlled in angular position by a drive system (not shown) to rotate the workpieces 12 during the grinding cycle. The spindle portions 16 and 18 may be separated and driven together for releasing and clamping workpieces 12 by means of a clamping device 22. The spindle 16, 18 is more fully described in U.S. Pat. No. 3,427,761 to Walter A. Kulson and the clamping means 22 is more fully described in U.S. Pat. No. 3,697,060 also issued to Walter A. Kulson. Inserts 12, when finished, are released from the spindle clamp 16, 18 and dropped into a discharge chute 24 which is disposed immediately beneath the clamping position.

From the brief foregoing description, it can be seen that precise position correlation between the magazine 14, the carrier 32 and the clamping spindles 16, 18 is required to perform the grinding operation. The original orientation of the inserts 12 in magazine 14 must be preserved during the transfer since this orientation determines the starting or reference position for the angular displacements effected by spindle 18 during the grind process. Inserts 12 must be laterally loaded into the carrier 32 so as to avoid dropping or failure to load, must be axially removed or released from carrier 32 at the clamping position and must provide clearance for access to the inserts 12 by spindles 16, 18 while still in the carrier seat. Apparatus 10 satisfies all of these requirements.

Going now to the details of the apparatus 10 relating to the transfer movement back-and-forth between the pick-up point represented by the left end of insert magazine 14 and the release point represented by the axis of clamping spindles 16, 18, reference is made to FIGS. 1 through 4. The transfer apparatus comprises a base plate 26 of heavy steel and having a rectangular configuration. Plate 26 is mounted on end on the grinder bed along with the magazine 14 and various other fixed components hereinafter described. The plane of plate 26 is substantially parallel to the direction of the reciprocal transfer movement. Plate 26 carries vertically spaced and parallel slide ways 28 and 30 having opposed V-shaped notches formed therein to receive a slidebar 34 which is secured by means of machine screws to a steel carrier plate 36. The reciprocal slide path of bar 34 between the slide ways 28 and 30 defines the axis of workpiece transfer movement and is perpendicular to the axis of the clamping spindles 16, 18.

Figures 4, 7:
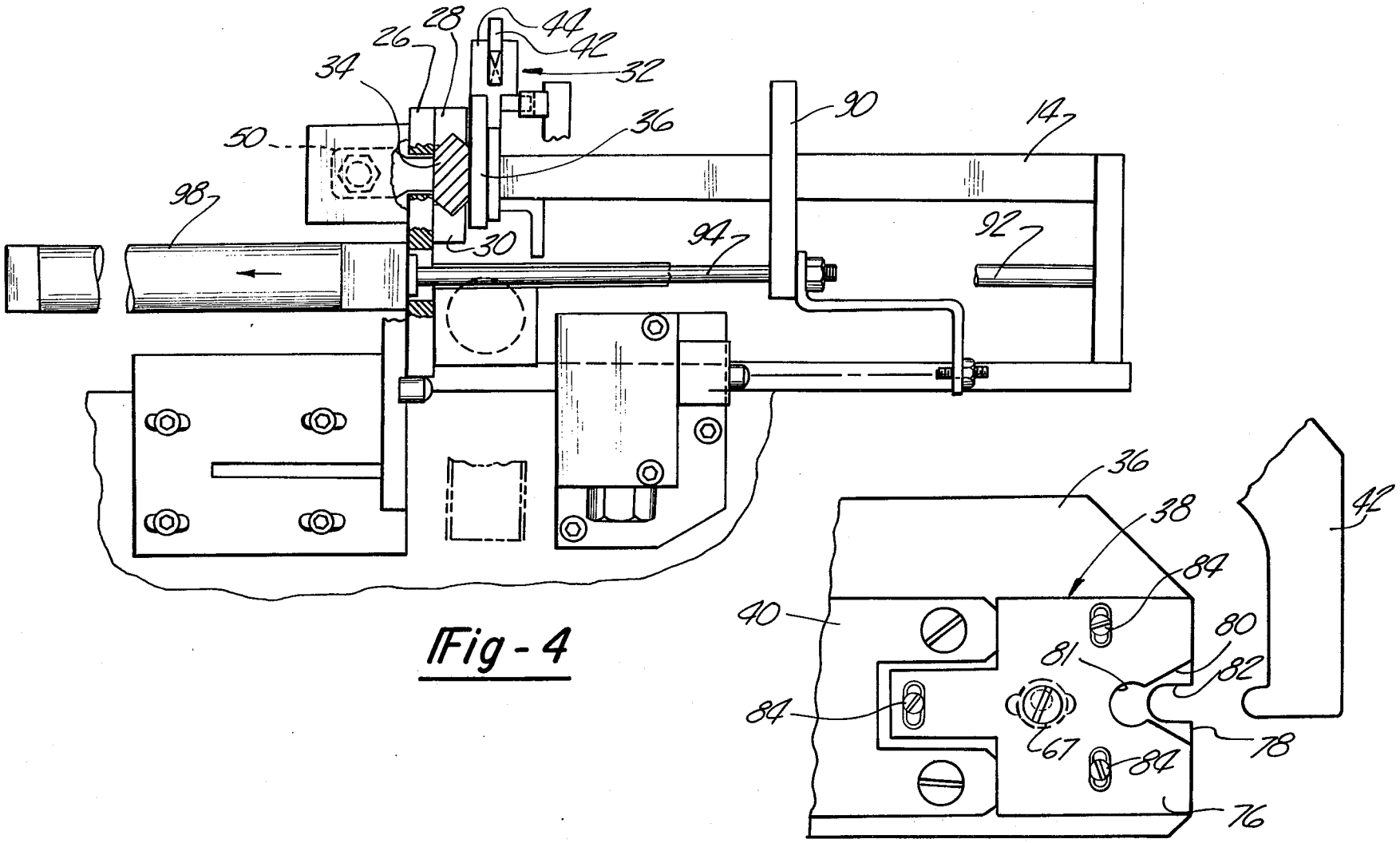
FIG. 4 is a sectional view along section line 4—4 of FIG. 1.

Carrier assembly 32 comprises the carrier plate 36 mounted on slidebar 34, a part holder assembly 38 which is mounted on carrier plate 36, a cover plate 40 which is mounted on carrier plate 36 by means of machine screws as is best shown in FIG. 3, and a retainer arm 42 which is mounted on carrier plate 36 by means of pivot bracket 44. The entire assembly 32, including plate 36, assembly 38, plate 40, arm 42 and bracket 44 is driven reciprocally between the insert pick-up and release positions by a double-acting air cylinder 48, the output rod of which is connected to the slidebar 34 by an arm 50 which extends through a longitudinal slot in plate 26 between slide ways 28 and 30 as best shown in FIG. 4. Forward travel, i.e., travel toward the spindle clamp 16, 18, is limited by stop block 52 having adjustable stop bolt 54 which engages a shoulder 56 on plate 26 to act as a limit stop. The threaded bolt 54 of the stop 52 permits adjustment in the exact definition of the end position of the carrier 32; i.e., the position wherein the insert 12 is released for clamping by spindles 16, 18. Travel in the retract direction may be similarly positively stopped or simply limited by the travel of the air cylinder plunger.

Carrier plate 36 is of flat rectangular configuration and as shown in FIG. 6 has four large holes 58 formed therein for attachment to the slidebar 34. The holes 58 are countersunk to receive socket head machine screws according to conventional practice. Plate 36 has formed therein a notch 60 at the forward end to provide clearance for the clamping spindles 16, 18 when in the advanced position as hereinafter described in detail. Plate 36 is further provided with a pair of vertically aligned slots 62 to receive locator pins 64 which project from the back side of part holder assembly 38, as shown in FIG. 5. Between the two vertically aligned slots 62 is a camming hole 66 in the form of a horizontally aligned slot to receive a cam screw 67 for adjustment of the position of the part holder assembly 38 on the carrier plate 36 as also hereinafter described in greater detail. Holes 68 are provided adjacent the top edge of plate 36 to receive mounting screws for the limit stop 52. Holes 70 are provided to receive the bracket 44 of part retainer arm 42.

A cover plate 40 having a rectangular notch 72 formed in the front edge thereof is provided with mounting holes 74 for attachment to the side surface of plate 36 by machine screws in the manner shown in FIGS. 3 and 7.

Part holder assembly 38 attaches to the side of plate 36 adjacent the front end thereof as shown in FIGS. 3 and 7. Assembly 38 comprises a front plate 76 having a rearwardly projecting extension 77 which fits between the fingers of the cover plate 40, and a second plate 78 which fits into a milled relief on the back of plate 76, as best shown in FIG. 5. Plate 76 has formed therein an open-ended triangular seat 80 terminating inwardly in the circular bore 81 to receive two edges of the inserts 12 from magazine 14 for the transfer process. Plate 78 has formed therein a recess 82 which is smaller than the recess 80 thereby to provide an exposed face for lateral support of the insert 12 while in the seat 80. Notch 82, however, provides clearance for the clamping spindles 16, 18 while the insert 12 is fully within the seat 80. Plate 78 is secured to the plate 76 by shallow machine screws as shown in FIG. 5 thus eliminating need for sliding or retractable components to provide lateral support for the inserts 12 while in the seat 80.

Assembly 38 is located on plate 36 by placing the pins 64 in the slots 62 of the plate 36. The slots 62 permit vertical adjustment of the position of assembly 38 on plate 36. When the desired position is achieved, three machine screws 84 extending through slot-shaped, countersunk holes in assembly 38 into tapped holes in plate 36 are tightened down to maintain the selected position.

Adjustment of the position of assembly 38 on plate 36 is accomplished by means of the cam screw 67. Screw 67 comprises a head which is slotted to receive the standard screwdriver blade and which extends through the bore 86 in assembly 38, a radial flange 88 of enlarged diameter which fits between assembly 38 and plate 36 and an offset cam shank 90 which extends into the slotted hole 66 in plate 36. Rotation of the screw produces a shift between plate 36 and assembly 38. However, because the hole 66 in plate 36 is slotted horizontally, the rotation of screw 67 is operative to cause displacement of assembly 38 only in the vertical direction. Accordingly, cam screw 67 is employed to accomplish precise vertical adjustments, while limit stop 52 is employed to accomplish precise longitudinal position adjustments. After cam screw 67 is properly adjusted, the machine screws 84 are tightened down to preserve the precise position.

Magazine 14, as shown in FIGS. 1 and 2, comprises a two-sided tray for supporting the inserts 12 in stacked parallel relationship therein. The orientation of inserts 12 in magazine 14 corresponds to the initial orientation of the inserts in the grinding process and, accordingly, must be carefully controlled. Inserts 12 are free to slide laterally in magazine 14 and are biased toward the transfer assembly 32 by arm 90 which is mounted on guide rod 92 for sliding relationship parallel to the stacking axis of magazine 14. The arm 90 is connected by way of rod 94 through plate 26 to air cylinder 98 which receives air pressure by way of line 100. Supply line 100 extends to relief valve 102 and thence to a supply source (not shown) for controlled application of actuating pressure to the cylinder 98. Valve 102 is controlled by arm 104 carrying wheel 106 which, in turn, is engaged by the adjustable stop bolt 108 of arm 110 which is mounted for displacement with slidebar 34. The function of valve 102 is to interrupt air pressure to cylinder 98 as soon as the carrier assembly 32 starts forward from the insert pick-up position toward the clamping position represented by spindles 16, 18. In doing so, pressure on the stack of inserts 12 is relaxed thus to minimize wear due to the sliding of the part holder assembly 38 and the cover plate 40 past the next insert 12 in the stack to be transferred. It will be noted that the faces of assembly 38 and cover plate 40 must all be flush to accommodate the sliding of the components past the inserts 12 in the magazine 14 as described. Accordingly, valve 102 is normally closed so as to relieve insert stack pressure but is opened to apply the bias to the insert stack by way of cylinder 98 and arm 90 whenever stop 108 engages wheel 106 on the control arm 104. Stop 108 is adjusted to engage wheel 106 only when the carrier assembly 32 is fully retracted; i.e., in the part pick-up position. Therefore, the insert 12 which is next in line for transfer is automatically laterally thrust into the seat 80 of assembly 38 against the exposed surface of plate 78 and retained by the depending arm 42. As soon as the carrier assembly 32 starts forward, stop 108 moves away from wheel 106 to again relax the stack pressure.

Chute 24 is pivotally mounted in bifurcated bracket 112 which is connected via a control rod to air cylinder 114 which is also a double-acting or two-way device. When cylinder 114 is extended, the chute pivots over the lip 116 of the grinder slide to assume the substantially horizontal position under the workpiece spindle clamp as best shown in FIG. 3. Accordingly, as the spindles 16, 18 are opened, the finished part drops in the chute where it is held until the new insert is clamped. Accordingly, should the new insert fail to achieve the clamping position, it will fall into the chute 24 immediately below. Cylinder 114 is then activated in a reverse direction along with cylinder 48 to withdraw the chute 24 along with the carrier assembly 32. As chute 24 passes over the lip 116 of the grinder slide, it pivots downwardly to drop the insert 12 into a container 118 as shown in FIG. 3.

The method of operation of the apparatus thus far described is as follows. It is assumed that initially the inserts 12 are loaded into the magazine 14 and the carrier 32 is retracted so as to apply pressure to cylinder 98 urging the first insert 12 into the seat 80 and against the exposed lateral surface of plate 78. It is further assumed that the clamping means 22 is operated to open spindles 16, 18 and that the system is otherwise operational.

The first step is to activate air cylinders 114 and 48 causing chute 24 to assume the position shown by solid lines in FIG. 3 where it is directly under the spindle clamping arrangement 16, 18. Energization of cylinder 48 drives the carrier assembly 32 forward closing relief valve 102 and relaxing pressure on the insert stack as previously described. Insert 12 is held within seat 80 by retainer arm 42 which is biased by spring 46 as best shown in FIG. 6. When the assembly 32 is fully advanced, an interlock switch 120 is closed by stop 122 abutting switch plunger 124. Clamping means 22 is thus rendered operational to close spindles 16, 18, clamping the insert 12 into the grind position where it can be carried through the grind program by rotation and/or axial displacement of the spindle clamping assembly. Thereafter, carrier 32 is retracted by reverse operation of cylinder 48 to bring the part holder assembly 38 into position to receive the next insert in stack 14. When stop 108 hits wheel 104 pressure is again applied to the stack by way of cylinder 98 and arm 90 to laterally urge the next insert into the seat 80. At the finish of the grind operation cylinder 114 is activated to advance chute under the part. Carrier 32 is again extended, spindles 16, 18 are opened to drop the finished part on the chute 24 and to receive the next part to be ground. Spindles 16, 18 are closed on the new part and the carrier 32 and chute 24 are retracted together. The cycle repeats. While this process can be performed using manual control for programming, automatic control is preferred.

It is to be understood that the invention has been described with reference to a specific illustrative embodiment and accordingly the foregoing description is not to be construed in a limiting sense.

I claim:

1. Apparatus for transferring workpieces from a magazine stack to a clamping spindle comprising: a slide body mounted for reciprocal displacement between a pick-up position and a release position; part holder means on the slide body and defining a seat for receiving the workpieces laterally thereof and releasing the workpieces axially and incrementally urging the workpieces into the seat when the body is in the pick-up position; and means for adjusting the position of the part holder means with respect to the slide body to relocate the relative position of the seat thereon for precisely receiving the workpieces therein, said part holder means comprising a plate having a surface for facial abutment against a surface of the slide body, a cam aperture formed in the plate, a cam hole in the body and aligned with the cam aperture when the plate is on the body, and a cam screw extending into the hole through and in contact with the aperture for displacing the plate relative to the body upon rotation thereof.

2. Apparatus as defined in claim 1 wherein the part holder comprises first and second plates secured together in parallel abutting relation, the first plate having a first recess formed in and opening to an end thereof and configured according to the workpieces, the second plate having a second recess of lesser height and depth formed in and opening to an end thereof, the first and second recesses being aligned to form the seat for the workpieces, to provide lateral support for the workpieces, and to permit clamping of the workpieces by spindle clamp means extending laterally of said plates while in the seat.

3. Apparatus as defined in claim 2 including a retainer arm pivotally mounted on the slide body, and means resiliently urging the arm into a position adjacent with the open end of said seat to hold seated workpieces in the seat.

4. Apparatus as defined in claim 1 including power means for reciprocally displacing the slide body between said pick-up and release positions.

5. Apparatus as defined in claim 4 wherein said magazine means comprises bias means for urging a stack of workpieces toward the slide body for pick-up thereof.

6. Apparatus as defined in claim 5 further including means responsive to the position of the slide body for disabling the bias means as the slide body moves toward the release point thereby to release pressure on the stack except when the slide body is in the pick-up position.

7. Apparatus as defined in claim 4 further including a workpiece discharge chute disposed beneath the release position for receiving workpieces released by the clamping spindle.

8. Apparatus as defined in claim 7 including means for reciprocally displacing the discharge chute.

9. Apparatus as defined in claim 1 wherein the workpieces are flat-sided triangular objects, said seat being of substantially open-ended triangular configuration for receiving the workpieces therein.

10. Apparatus for transferring workpieces from a magazine stack to a clamping spindle comprising a slide body mounted for reciprocal displacement between a pick-up position and a release position, part holder means on the slide body and defining a seat for receiving the workpieces laterally thereof and releasing the workpieces axially thereof, magazine means for receiving a stack of aligned workpieces and incrementally urging the workpieces into the seat when the body is in the pick-up position, and bias means operable on said magazine means for urging the stack of workpieces toward the slide body, said bias means including means responsive to displacement of the slide body away from the pick-up position to release bias pressure on the stack.

11. Apparatus as defined in claim 10 wherein the bias means comprises an air cylinder having an output arm and means connected between said output arm and the workpieces in said magazine for urging the stack of workpieces toward the part holder means, said means responsive to displacement of the slide body comprising a relief valve operatively connected to the air cylinder to interrupt the air pressure thereon and relax the bias pressure on the workpiece stack whenever the slide body displaces away from the pick-up position.

12. For use in an apparatus for transferring workpieces from a magazine stack to a clamping spindle a part holder assembly comprising a first plate of rigid material and having an opening formed in an end thereof to define a workpiece seat, and a second plate in parallel abutting relationship with the first plate and substantially overlapping said opening, a second opening being formed in the second plate and partially coextensive with but of lesser dimension than the first opening for providing a lateral workpiece support surface for workpieces in said seat.

13. Apparatus as defined in claim 12 including means for mounting the part holder on a carrier plate and means for adjusting the position of the work holder on the carrier plate.

* * * * *